US006337469B1

(12) United States Patent
Chung

(10) Patent No.: US 6,337,469 B1
(45) Date of Patent: Jan. 8, 2002

(54) COOKER

(75) Inventor: Chong-mo Chung, Suwon (KR)

(73) Assignee: Samsung Electronics Co., Ltd.

( * ) Notice: Subject to any disclaimer, the term of this patent is extended or adjusted under 35 U.S.C. 154(b) by 0 days.

(21) Appl. No.: 09/651,784

(22) Filed: Aug. 30, 2000

(30) Foreign Application Priority Data

| | | |
|---|---|---|
| Sep. 10, 1999 | (KR) | 99-38649 |
| Aug. 5, 2000 | (KR) | 00-45470 |
| Aug. 25, 2000 | (KR) | 00-49443 |

(51) Int. Cl.[7] ..... H05B 1/02; H05B 6/68
(52) U.S. Cl. ..... 219/506; 219/720
(58) Field of Search ..... 219/490, 506, 219/702, 703, 705, 719, 720; 99/325

(56) References Cited

U.S. PATENT DOCUMENTS

| | | | |
|---|---|---|---|
| 4,177,370 | A | 12/1979 | Otani |
| 4,324,966 | A | 4/1982 | Tanabe |
| 4,459,449 | A | 7/1984 | Hirata |
| 5,345,067 | A | 9/1994 | Ohta et al. |
| 5,349,164 | A | 9/1994 | Ohta |
| 5,373,142 | A | 12/1994 | Ohshima et al. |
| 5,607,611 | A | 3/1997 | Lee |
| 5,906,765 | A | 5/1999 | Miura et al. |
| 6,111,240 | A * | 8/2000 | Kishimoto et al. ..... 219/720 |

* cited by examiner

*Primary Examiner*—Sang Paik
(74) *Attorney, Agent, or Firm*—Robert E. Bushnell, Esq.

(57) ABSTRACT

A cooker has a main body, a control panel and a heat source for cooking which is controlled by the control panel. The control panel comprises a support plate installed on a surface portion of the main body, a manipulation unit movably installed on the support plate, a memory storing a plurality of menu groups, a plurality of menus belonging to each menu group and a cooking condition for each menu, a device installed on the support plate for displaying the menu groups according to movement of the manipulation unit, a further device installed on the support plate for displaying the menus belonging to each menu group according to movement of the manipulation unit, a selection unit for selecting a desired menu group and a desired menu from the menu groups and the menu displayed on the menu group displaying device and the menu displaying device, respectively, and a controller for controlling the heat source to perform the cooking condition of the selected menu according to selection of the selection unit. With this configuration, a variety of menus to be cooked are displayed and a user can easily select his or her desired menu among the displayed menus. Additionally, the support plate can be used more efficiently in space and the menus to be cooked can also be efficiently displayed.

16 Claims, 9 Drawing Sheets

COOKER

CLAIM OF PRIORITY

This application makes reference to, incorporates the same herein, and claims all benefits accruing under 35 U.S.C. §119 from applications for COOKER AND CONTROLLING METHOD FOR SELECTING THE COOK MENU THEREOF earlier filed in the Korean Industrial Property Office on the 10th of September 1999 and there duly assigned Ser. No. 38649/1999, for COOKER earlier filed in the Korean Industrial Property Office on the 5th of August 2000 and there duly assigned Serial No. 45470/2000, and for COOKER earlier filed in the Korean Industrial Property Office on the 25th of August 2000 and there duly assigned Ser. No. 49443/2000.

TECHNICAL FIELD

The present invention relates in general to cookers, and more particularly to a cooker with a support plate improved in structure and function.

DESCRIPTION OF RELATED ART

For the sake of convenience, the present invention will be described with reference to a microwave oven as an exemplary cooker.

Generally, a microwave oven serves to cook food with a magnetron generating microwaves. The time and intensity of microwaves generated from the magnetron, i.e., cooking time and cooking temperature, vary depending upon the kind of food to be cooked. According to selection methods of the cooking time and temperature, the cooking modes of the microwave oven are divided into an automatic cooking mode and a manual cooking mode.

Under the manual cooking mode, a user can optionally select desired cooking time and temperature. If the cooking time and temperature are selected by the user, a controller in the oven drives the magnetron to cook food as selected.

In contrast, under the automatic cooking mode, a user can select a desired menu making use of a menu display provided in the front of the microwave oven, according to recipes for a plurality of menus stored in a memory in conjunction with cooking time and temperature. If the user selects a menu, a controller reads out the recipe for the selected menu from the memory and drives the magnetron to cook food according to the read out recipe.

Referring to FIG. 9, a control panel for selecting a menu in a conventional microwave oven which employs an automatic cooking mode is illustrated. As illustrated, the conventional control panel has a support plate 101 installed on the front of a component chamber (not shown) formed in the microwave oven. In the upper part of the support plate 101 are provided four menu displays 110 in their respective boxes. Below the menu displays 110 is installed a rotary knob for selecting a desired menu. In the lower part of the support plate 101 are respectively provided a menu selection button 121 on the left and a cooking start button 122 on the right.

Each menu display 110 is comprised of a plurality of menu bars 111 on the right, indicating "Popcorn," "Warming," "Thawing," etc., and menu group bars 113 A, B, C and D in the center, each indicating a group of menus. On the left of the menu bar 111 are disposed light-emitting diodes(LEDs) 115 corresponding to the respective menus whereas a light-emitting diode(LCD) 117 corresponding to each menu group bar 113 is disposed on the left of the menu group bar 113. These LEDs 115 and 117 are fixed to a Printed Circuit Board(PCB) (not shown) installed between the support plate 101 and the component chamber (not shown), and are exposed to the outside.

Light is emitted from the LED 117 for the menu group bar 113 when the rotary knob 120 is positioned at a rotation position corresponding to each of the menu displays 110. The LEDs 115 for the menus are lighted when the rotary knob 120 is positioned at a rotation position corresponding to each of the menu bars 111. The LEDs 115 and 117 are lighted by a driver (not shown) for driving these LEDs, and the driver is operated by the menu selection button 121 and the rotary knob 120.

According to the conventional microwave oven, a menu selection through the support plate is performed in the following manner.

If a user presses the menu selection button 121, the LED driver drives the LEDs 115 and 117 of one menu display 110 according to the rotation position of the rotary knob 120. The user can select his or her desired menu group and menu by rotating the rotary knob 120.

The LEDs corresponding to the desired menu group and menu are lighted, and then the user selects the desired menu by operating a switch for menu selection (not shown). The menu selection switch is configured to cooperate with the rotation of the rotary knob 120.

Then, if the user presses the cooking start button 122, a controller (not shown) reads out a recipe for the menu selected by the user from the memory and drives the magnetron.

However, because a support plate has a limited area in the conventional microwave oven, only a limited number of menus can be displayed.

As the menu group bars or menu bars increase in number, this makes it inconvenient to select a menu. In addition, since the number of LEDs increases, the circuitry becomes complicated.

SUMMARY OF THE INVENTION

The present invention has been made keeping in mind the above-described problems, and an object of the present invention is to provide a cooker with a support plate improved in structure and function to display a variety of menus and cooking conditions.

The above and other objects of the present invention may be achieved by the provision of a cooker comprising a main body, a control panel and a heat source for cooking which is controlled by the control panel, the control panel comprising a support plate installed on a surface portion of the main body, a manipulation unit movably installed on the support plate, a memory storing a plurality of menu groups, a plurality of menus belonging to each menu group and a cooking condition for each menu, a device installed on the support plate for displaying the menu groups according to movement of the manipulation unit, a further device installed on the support plate for displaying the menus belonging to each menu group according to movement of the manipulation unit, a selection unit for selecting a desired menu group and a desired menu from the menu groups and the menu displayed on the menu group displaying device and the menu displaying device, respectively, and a controller for controlling the heat source to perform the cooking condition of the selected menu according to selection of the selection unit.

Preferably, the manipulation unit comprises a rotary knob being rotatable.

Preferably, the selection unit comprises a selection switch operating by pushing of the rotary knob.

Effectively, the menu group displaying device includes an annular display for displaying the menu groups in sequence around the rotary knob.

Preferably, the annular display includes a plurality of icons for displaying the menu groups.

Effectively, the cooker further comprises a plurality of LCDs corresponding to the respective icons of the annular display.

Effectively, the menu displaying device displays the menus on the annular display according to rotation of the rotary knob in sequence.

Effectively, the menu displaying device comprises a second display for displaying the menus according to rotation of the rotary knob in sequence.

Preferably, the second display displays the respective menus one by one and in sequence.

Preferably, the second display highlights the menu corresponding to the rotation position of the rotary knob among the plurality of menus to be displayed on the second display.

Preferably, the menu group displaying device includes a display for displaying the menu groups in sequence according to rotation of the rotary knob.

Preferably, the menu displaying device displays the menus under the menu group selected through the selection unit on the display.

Preferably, the display displays the respective menu groups one by one and in sequence.

Preferably, the display highlights the menu group corresponding to the rotation position of the rotary knob among the plurality of menu groups to be displayed on the display.

Preferably, the cooker comprises an indicator for indicating rotation positions of the rotary knob.

Preferably, the indicator is provided on the rotary knob.

Preferably, the indicator comprises a plurality of LEDs provided around the rotary knob, corresponding to rotation positions of the rotary knob.

Preferably, the plurality of LEDs are lighted sequentially during cooking.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

MODES CARRYING OUT THE INVENTION

Figure 1:
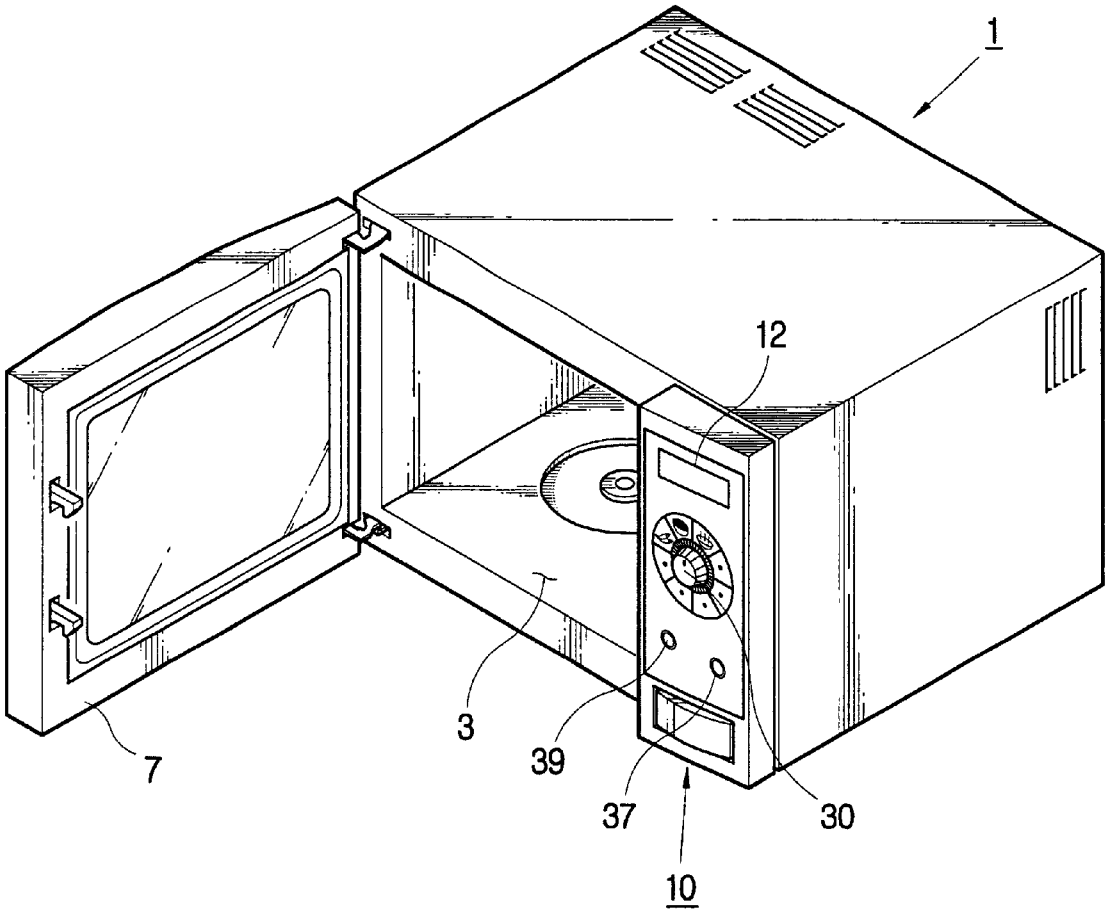
FIG. 1 is a perspective view of a microwave oven according to the present invention.

A microwave oven according to the present invention is, as illustrated in FIG. 1, comprised of a main body 1 partitioned into a cooking chamber 3 and a component chamber (not shown), a door 7 for opening and closing the cooking chamber 3, and a control panel 10 mounted in front of the component chamber. A magnetron, a high-voltage transformer and a high-voltage capacitor, all of them being not shown herein, are positioned in the component chamber.

Figure 2:
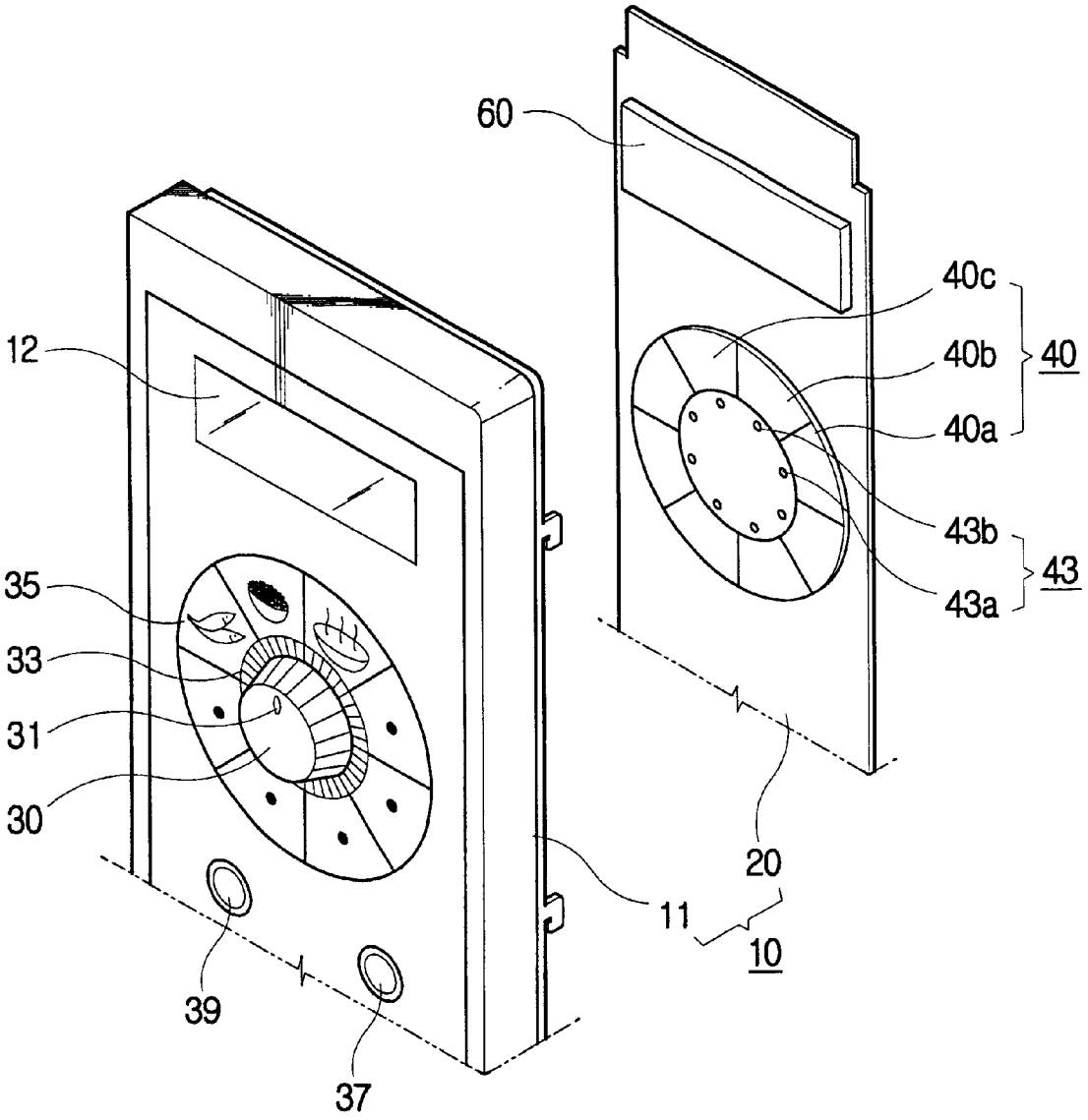
FIG. 2 is an exploded perspective view of a control panel of the microwave oven according to a first embodiment of the present invention.
Figure 3:
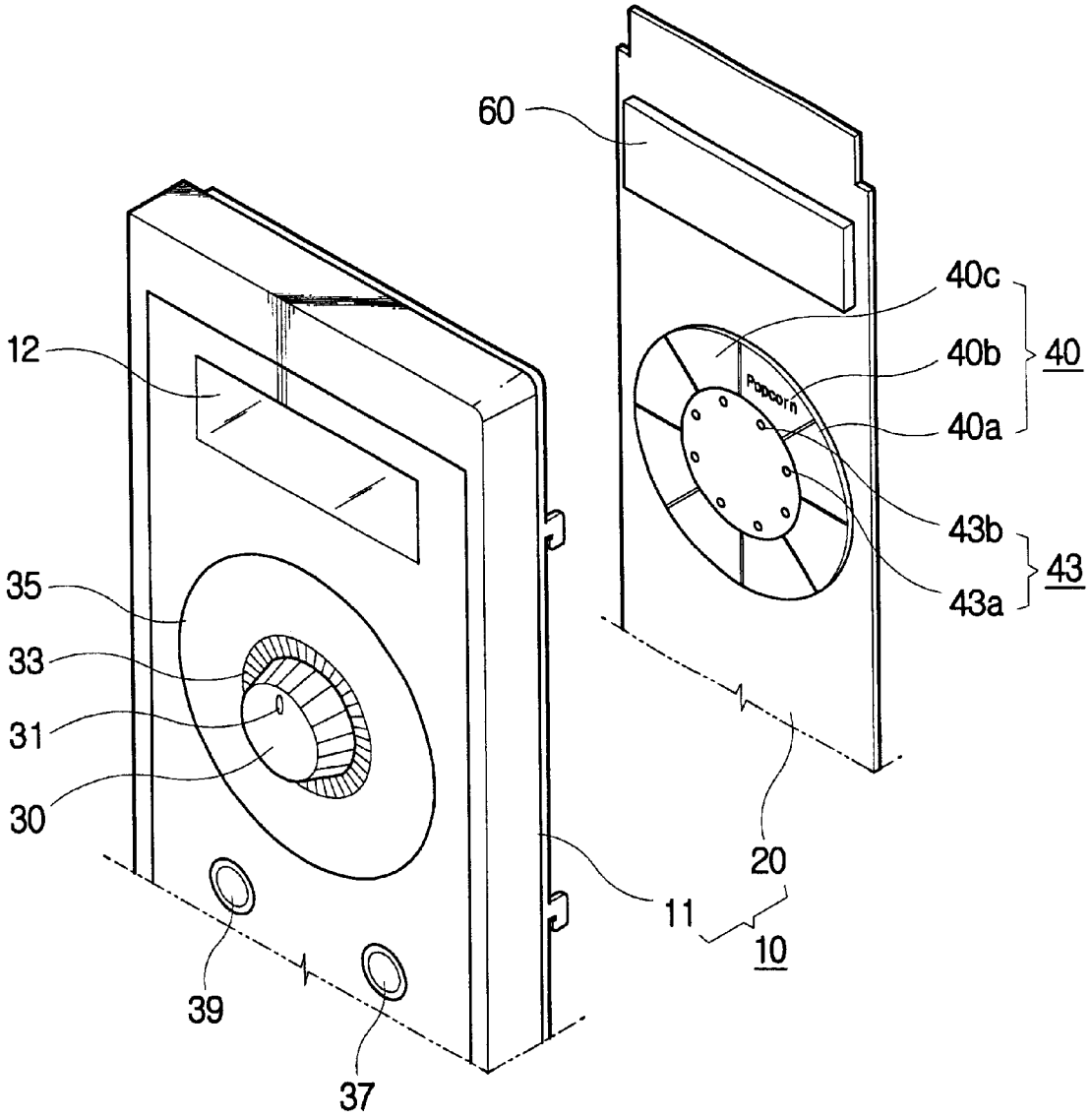
FIG. 3 is an exploded perspective view of a control panel of the microwave oven according to a second embodiment of the present invention.

The control panel 10 according to the present invention is, as depicted in FIGS. 2 and 3, comprised of a support plate 11 in front of the component chamber, and a printed circuit board(PCB) 20 at the rear of the support plate 11.

At the center of the support plate 11, a manipulation unit is provided. The manipulation unit is movably or rotatably installed so as to look for a menu group, a menu belonging to the menu group and a cooking condition therefor. In the support plate 11, a device 35 for displaying the plurality of menu groups and a device 12 for displaying the plurality of menus belonging to the menu groups are also provided. The support plate 11 is provided with a memory (not shown) for storing a plurality of menu groups, a plurality of menus belonging to each menu group, and a plurality of cooking conditions for the plurality of menus.

According to the first and second embodiments of the present invention, as illustrated in FIGS. 2 and 3, a rotary knob 30 serves as the manipulation unit for looking for a menu group, the menu belonging to the menu group and the cooking condition for the menu. Preferably, the rotary knob 30 additionally includes a selection function for selecting the menu group, the menu belonging to the menu group and the cooking condition therefor. The selection function is performed by a selection switch (not shown) which operates with pushing of the rotary knob 30 for each menu group, each menu belonging to the menu group and each cooking condition for the menu. Desirably, the rotary knob 30 has the functions of initiating a selection of a desired cooking menu and starting cooking. On the rotary knob 30 is provided a marker 31 for pointing out a rotation position of the rotary knob 30. With or instead of the marker 31, an LED display 33 having a plurality of sections may be provided around the rotary knob 30, for indicating the rotation position of the rotary knob 30.

The device 35 for displaying the menu group is comprised of an annular display disposed around the LED display 33 for displaying a plurality of menu groups continuously. The annular display 35 is comprised of a plurality of icons indicating the menu groups. The device 12 for indicating menus belonging to the menu groups is comprised of a rectangular display provided in the upper part of the support plate 11 for displaying a plurality of menus belonging to a menu group which is displayed through the icon corresponding to the rotation position of therotaryknob 30. The display 12 can display a plurality of cooking conditions of a selected menu.

Preferably, in the lower part of the support plate 11 is provided a button 39 for canceling a selection of a menu group, a menu and a cooking condition thereof selected by the rotary knob 30. A button 37 for multi-purpose use maybe further provided in the lower part of the support plate 11. The multi-purpose button 37 may be used for selecting a desired menu, initiating a selection of a desired menu or initiating cooking of the selected menu, in lieu of those functions of the rotary knob 30.

In the PCB 20 is provided an LCD portion 40 which is comprised of a plurality of LCD sections denoted as 40*a*, 40*b* . . . to correspond to the respective icons of the annular display 35 provided at the support plate 11. Referring to FIG. 3, the respective menu groups displayed in the LCD sections 40*a*, 40*b*, . . . of the LCD portion 40 are indicated in the annular display 35.

In the PCB 20 is also provided an LED indicator 43 having a plurality of LEDs 43*a*, 43*b*, . . . for indicating rotation positions of the rotary knob 30 in response to each icon correspondingly positioned relative to the LED display 33 in the support plate 11. The respective LEDs 43*a*, 43*b*, . . . can emit light by an LED driver 45 (see FIG. 7) operating in accordance with the rotary knob 30 being operated to initiate a selection of a desired menu to be cooked. The respective LEDs 43*a*, 43*b*, . . . are arranged to respectively correspond to the LCD sections 40*a*, 40*b*, . . . of the LCD portion 40. They selectively emit light when the rotary knob 30 is positioned at the LCD sections 40*a*, 40*b*, 40*c*, etc., so that a user is expressly informed of his or her selection of a menu group. Only the LCD section 40*a* located at the point where the rotary knob 30 is positioned may be lighted when the rotary knob 30 is positioned at the section 40*a* of the LCD 40. In addition to or instead of lighting the LCD section 40*a*, the corresponding LED 43*a* provided inside of the LCD section 40*a* may emit light.

In the PCB 20 is installed an LCD 60 located at the corresponding position of the rectangular display 12 installed in the support plate 11. The LCD 60 may serve as a timer for indicating a cooking time in a normal situation. If a signal for selecting a menu group through the rotary knob 30 or the multi-purpose button 37 is inputted, a user can easily find out his or her desired menu to be cooked from the LCD 60 in which menus belonging to the menu group and cooking conditions thereof are displayed in sequence. The menu group corresponding to an icon of the annular display 34 may be further displayed in the LCD 60, from which the user can know his or her selected menu group.

Figure 4:
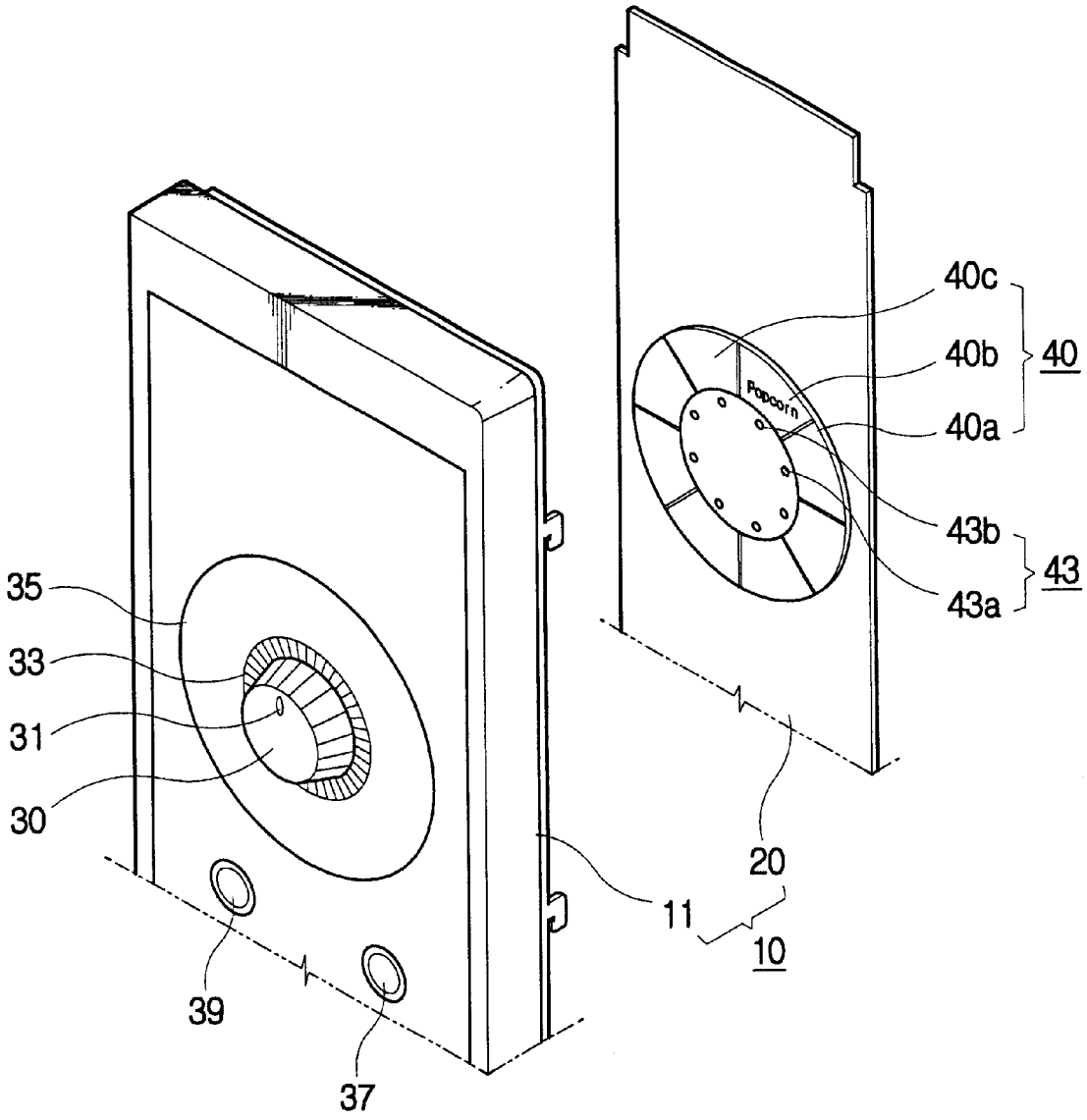
FIG. 4 is an exploded perspective view of a control panel of the microwave oven according to a third embodiment of the present invention.
Figure 5A:
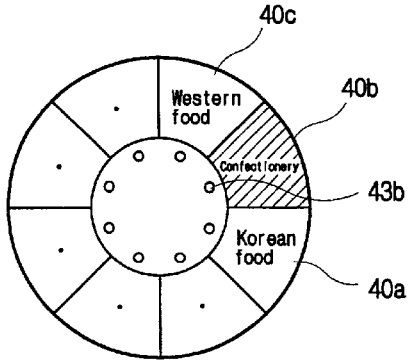
FIGS. 5*a*, 5*b* and 5*c* are schematic views of the control panel of FIG. 4 which show sequentially menu groups, menus and cooking conditions.
Figure 5B:
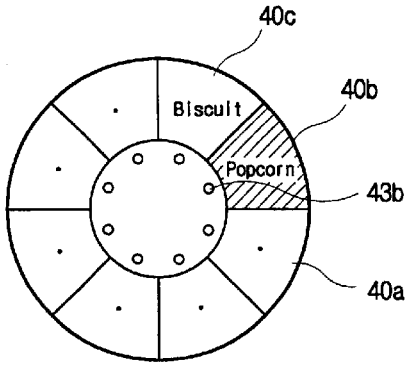
Figure 5C:
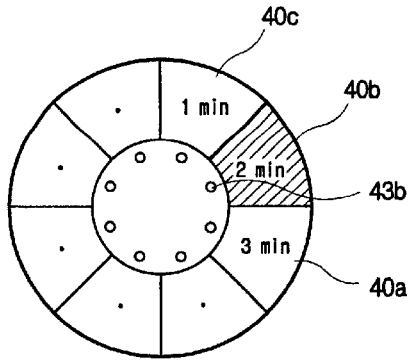

FIG. 4 is an exploded perspective view of a control panel of the microwave oven according to a third embodiment of the present invention, and FIGS. 5*a*, 5*b* and 5*c* are schematic views of the LCD portion and the LED indicator of FIG. 4 which show sequentially menu groups, menus and cooking conditions. The description of same parts or elements as those described above will be omitted hereinafter.

The rotary knob 30 for seeking and selecting a menu group, a menu belonging to the menu group and a cooking condition thereof is rotatably installed in the center of the support plate 11. In addition, it is preferable that the rotary knob 30 be capable of initiating selection of a desired menu and initiating cooking. At the circumference of the rotary knob 30 are provided an LED display 33 and an annular display 35 for indicating options of cooking.

In the PCB 20 are installed an annular LCD portion 40 located at the position corresponding to the annular display 35. The LCD portion 40 is comprised of a plurality of LCD sections 40*a*, 40*b*, 40*c*, . . . , each for indicating a menu group, a menu belonging to the menu group and a cooking condition thereof in sequence. Each LCD section of the LCD portion 40 is driven by an LCD driver 42 (see FIG. 7).

In the PCB 20 is installed an LED indicator 43 having a plurality of LEDs 43*a*, 43*b*, . . . located inside of the LCD portion 40, and being correspondingly positioned at the LCD sections corresponding to the LED display 33 in the support plate 11. The LED indicator 43 is driven by an LED driver 45 (see FIG. 7), and is selectively lighted when the rotary knob 30 is positioned at one LCD section of the LCD portion 40. For example, as illustrated in FIGS. 5*a*, 5*b* and 5*c*, when the rotary knob 30 is positioned at the LCD section 40*b* indicating confectionery among the menu groups, the corresponding LED 43*b* inside the LCD section 40*b* is lighted. Where a menu group is selected by the rotary knob 30, a plurality of menus belonging to the menu group is indicated on the respective LCD sections 40*a*, 40*b*, etc. Where a menu is selected, cooking conditions of the respective menus are sequentially displayed in each LCD section.

Figure 6:
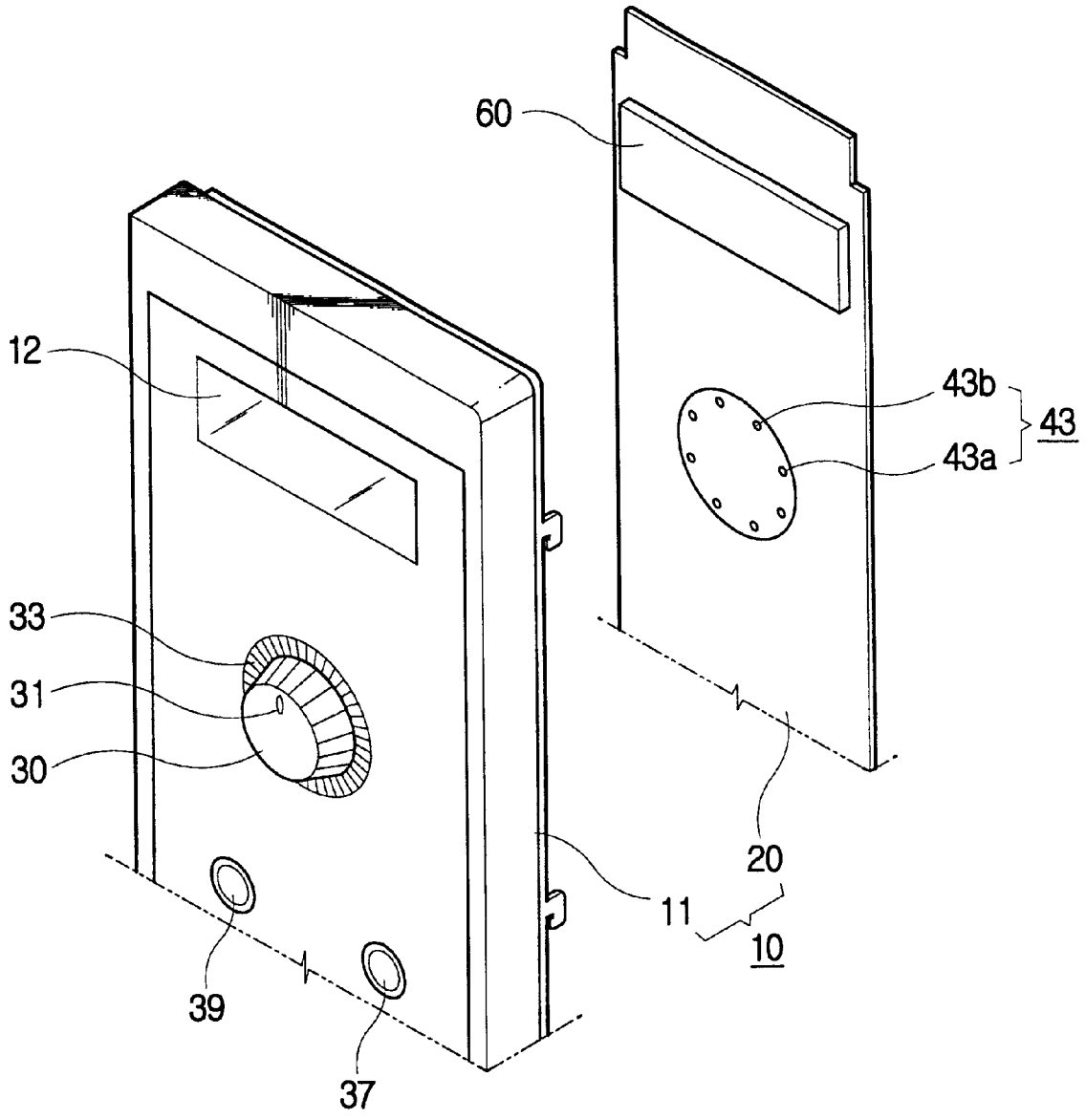
FIG. 6 is an exploded perspective view of a control panel of the microwave oven according to a fourth embodiment of the present invention.

FIG. 6 is an exploded perspective view of a control panel of a microwave oven according to a fourth embodiment of the present invention. As shown therein, the control panel 10 includes a support plate 11 in front of a component chamber (not shown) and a PCB 20 at the rear of the support plate 11.

At the center of the support plate 11 is provided a rotary knob 30 for looking for and selecting a menu group, a menu and a cooking condition. In the upper part of the support plate is provided a rectangular display 12 for displaying a plurality of menu groups, a plurality of menus belonging to the menu groups and cooking conditions for the menus in sequence.

On the circumference of the rotary knob 30 is provided an LED display 33 having a plurality of sections. In the lower part of the support plate is provided a button 39 for canceling selection of the cooking option selected by the rotary knob 30. A button 37 for multi-purpose use maybe further provided in the support plate.

In the PCB 20 is installed a plurality of LEDs 43*a*, 43*b*, . . . , corresponding to the respective sections of the LED display 33 of the support plate 11. The respective LEDs 43*a*, 43*b*, . . . are lighted by the LED driver 45 (see FIG. 4) operating according to initiation of a menu selection of the rotary knob 30. In the PCB 20 is installed an LCD 60 at the position corresponding to the rectangular display 12 installed in the support plate 11. The rotary knob 30 and the display 12 depicted in FIG. 6 are of the same as those described in reference to the other embodiments. Thus, the description thereof will be omitted.

Figure 7:
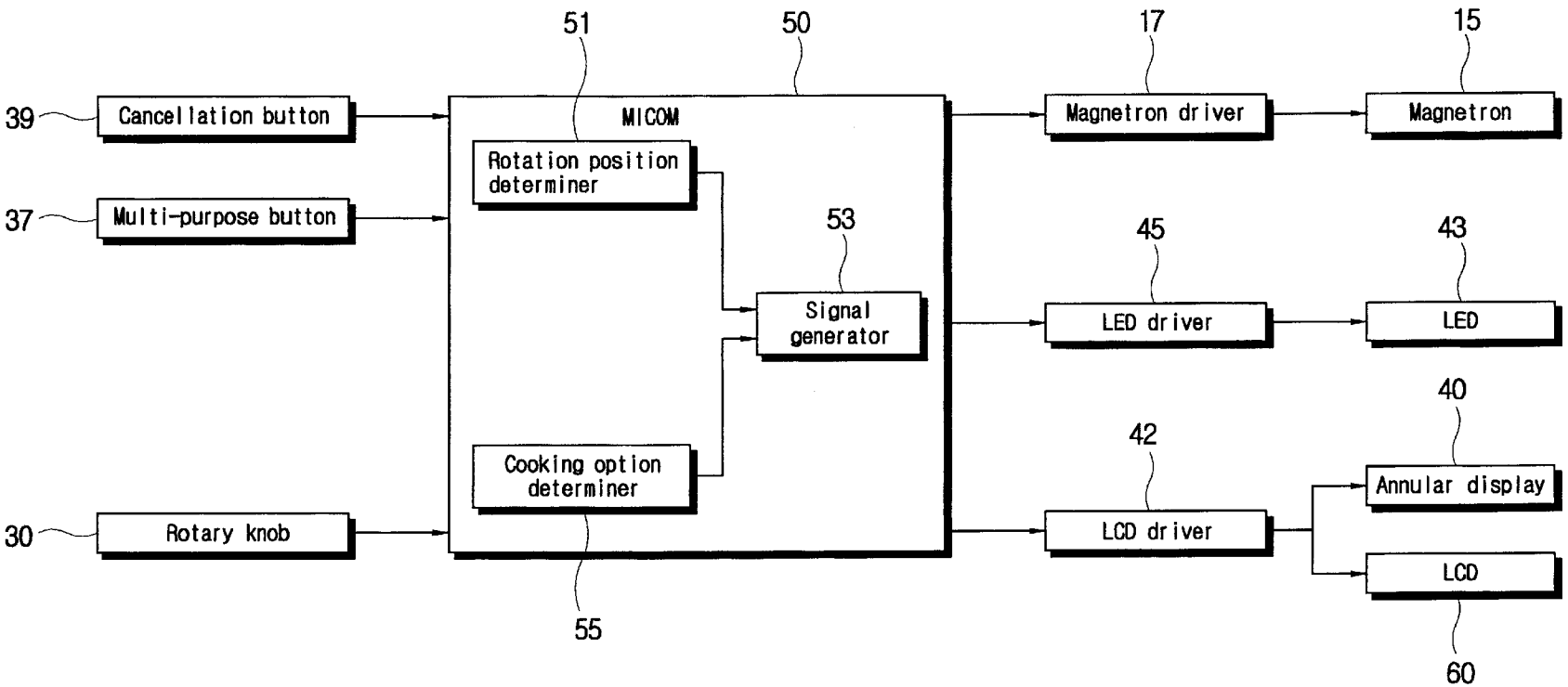
FIG. 7 is a block diagram of a controlling process according to the present invention.

A process for controlling operation of the control panel of the microwave ovens according to the above-described embodiments is shown in FIG. 7.

The controller 50 according to the present invention is, as illustrated, comprised of a determiner 51 for determining a rotation position of the rotary knob 30 based on a rotation angle of the rotary knob 30, a determiner 55 for determining a menu group, a menu and a cooking condition as a final cooking option based on a selection signal from the cooking option selection switch (not shown), and a driving signal generator 53 for generating signals for driving a magnetron driver 17, the LED driver 45 and the LCD driver 42.

Figure 8:
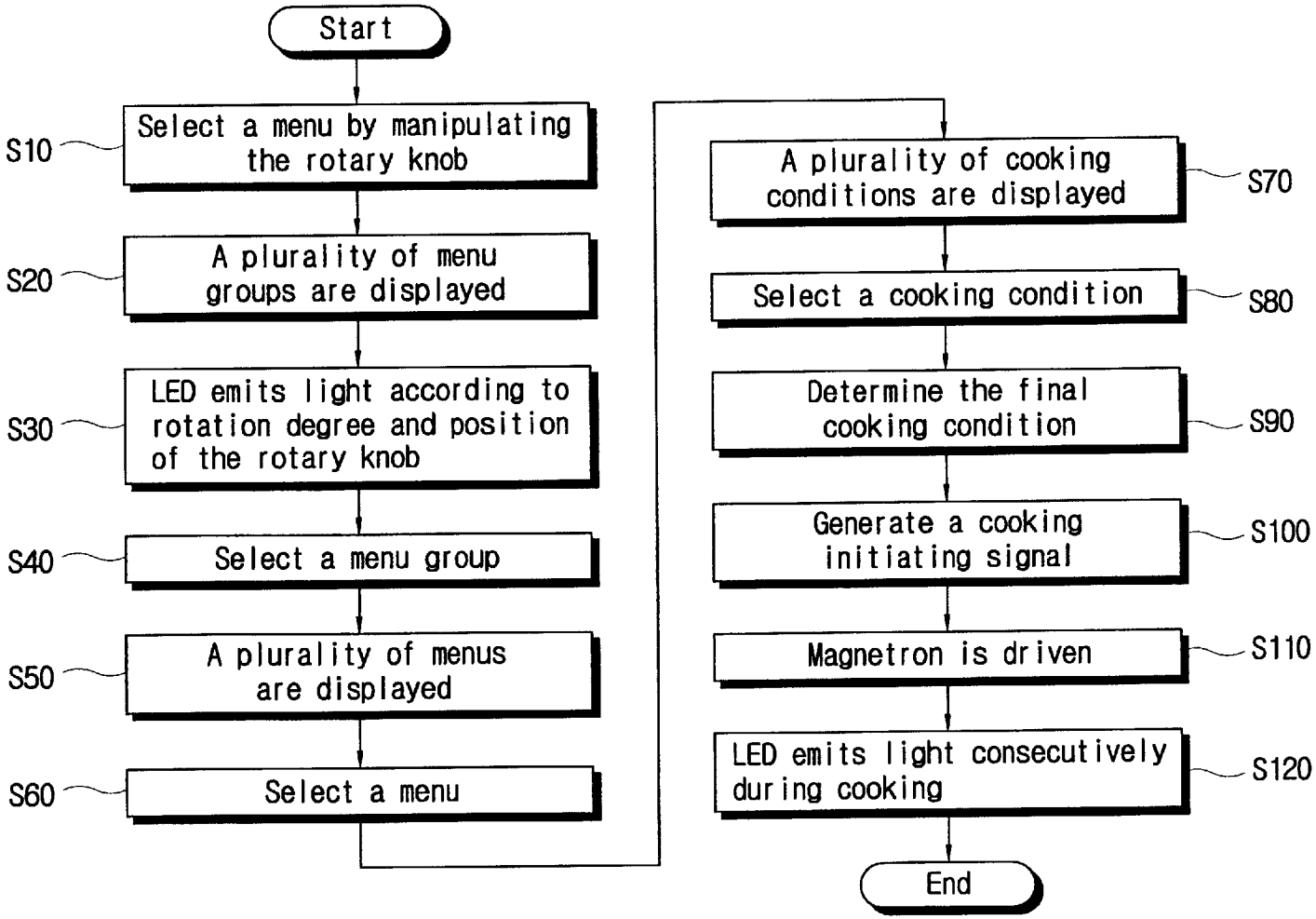
FIG. 8 is a flow chart showing a method of controlling a menu selection process according to the present invention.
Figure 9:
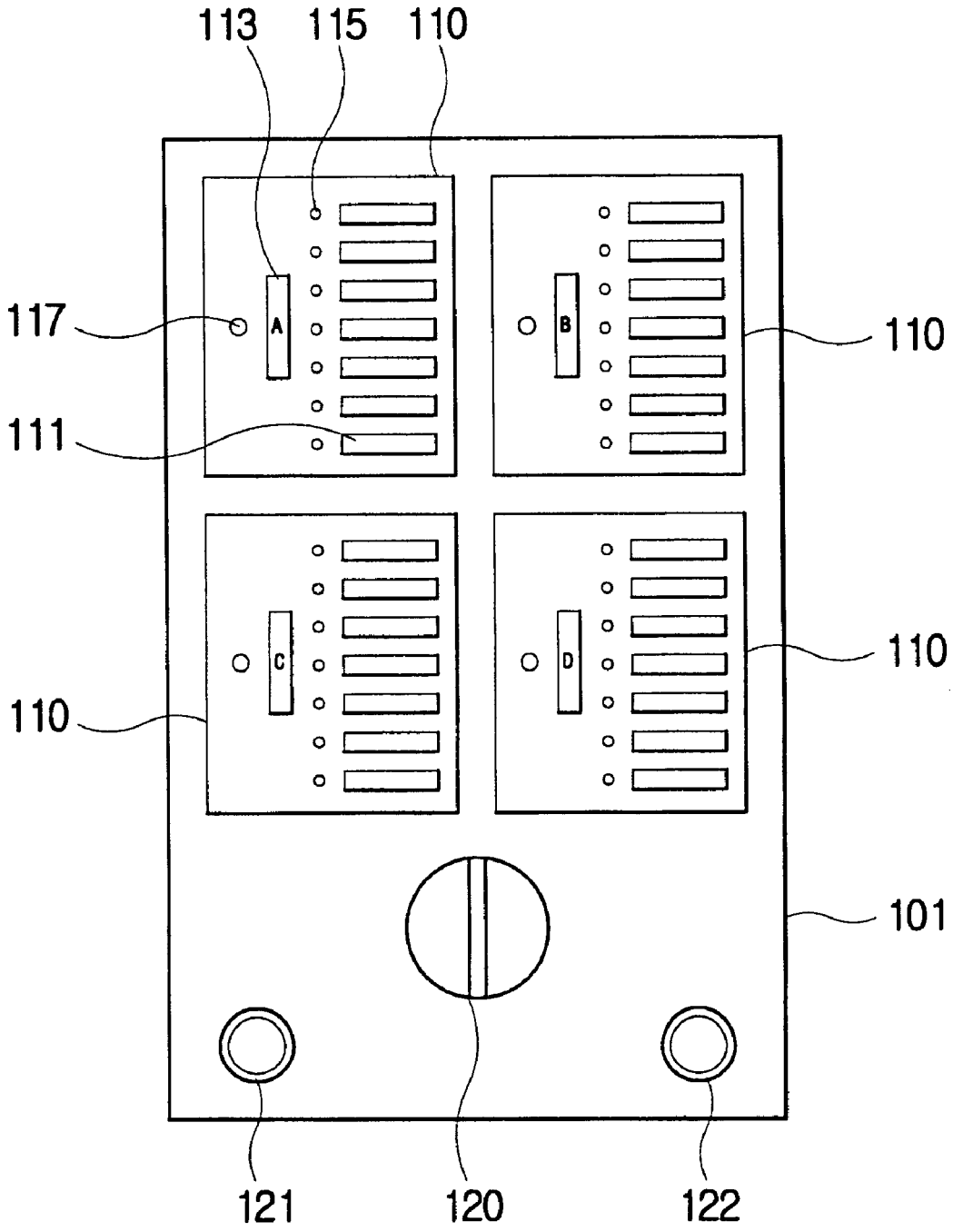
FIG. 9 (PRIOR ART)
FIG. 9 is a front elevational view of a control panel of a conventional microwave oven.

The process of controlling a selection of a desired cooking option through the controller 50 is described in reference to FIG. 2 and FIG. 8.

A user selects a menu to be cooked by manipulating the rotary knob 30 (S10). For example, a menu can be selected by pushing the rotary knob 30 for a determined period of time or rotating it toward a predetermined angle. Alternatively, the menu can be selected by pushing a multi-purpose button 37.

A signal to initiate a selection of a menu is inputted into the controller 50, and the controller 50 generates a signal for driving the LCD driver 42 so that a plurality of menu groups is displayed in the annular display 35 according to the menu selection initiating signal inputted (S20).

When the menu groups are displayed on the annular display 40, the user rotates the rotary knob 30 to point out his or her desired menu group. While the rotary knob 30 is being rotated by the user, the rotation position determiner 51 of the controller 50 determines the degree of rotation of the rotary knob 30. If the degree of rotation of the rotary knob 30 is determined, the controller 50 controls the LED driver 45 to generate a signal to emit light from the LED corresponding to the rotation position (S30).

The user selects a desired menu group indicated by a section of the LED display 33 corresponding to the lighted LED 43 by pushing the rotary knob 30 (S40).

When the menu group is selected by the user, a plurality of menus belonging to the selected menu group is displayed on the rectangular display 12 through the LCD 60 (S50).

The user can move to another menu by rotating the rotary knob 30 so as to select the other menu from the indicated menus (S60). If a desired menu group and a desired menu are selected, the user selects a desired cooking condition therefor by rotating the rotary knob 30 in the same manner as in selection of the menu group and the menu (S70 and S80).

When the user selects the desired menu group, menu and cooking condition therefor, the cooking option determiner 55 of the controller 50 finally determines the final cooking option in combination with the selected menu group, menu and cooking condition therefor (S90).

When the final cooking option is determined, the user operates the rotary knob 30 to generate a signal to initiate the cooking (S100). Alternatively, the cooking initiating signal can be generated by the separate button 37 which can serve as a cooking start button.

When the cooking start signal is inputted into the controller 50, the controller 50 controls the magnetron driver 17 to generate a signal to drive the magnetron so that food is cooked according to the final cooking option (S110).

While the food is being cooked by operation of the magnetron, the controller 50 controls the LED driver 45 to light the plurality of LEDs 43*a*, 43*b*, . . . consecutively so as to indicate that the cooking is taking place (S 120).

If the user makes a wrong selection on the menu group, the menu or the cooking condition, the selected cooking option can be cancelled by pushing the cancellation button 39 in any of steps S10 through S120.

According to the above-described embodiments of the present invention, LEDs 43*a*, 43*b*, . . . are provided on the circumference of the rotary knob 30 to indicate selection of a menu group, a menu and a cooking therefor. However, in addition to or instead of the LEDs 43, the respective sections 40*a*, 40*b*, 40*c*, etc. of the LCD portion 40 can be lighted.

The above-described first embodiment can be modified such that the menu groups, the menus belonging to each menu group, and cooking conditions therefor can be displayed in sequence on a plurality of icon sections of the rectangular display.

The embodiments of the present invention have been described in reference to a microwave oven only as an example. The present invention can be applied to bread makers, gas oven ranges and other cookers which employ the mode of automatic cooking.

In the above-described embodiments, there has been described a rotary knob which is rotatable. However, a menu group, a menu and a cooking condition therefor can be looked for and selected by using a slidable operator slidably moved or a joystick, etc.

As described above, the present invention makes it possible to increase the efficiency of using the space of the support plate and to indicate the menus and cooking conditions therefor in a simple structure on the support plate.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A cooker having a main body, a control panel and a heat source for cooking which is controlled by the control panel, the control panel comprising:

a support plate installed on a surface portion of the main body;

a manipulation unit movably installed on the support plate;

a memory storing a plurality of menu groups, a plurality of menus belonging to each menu group and a cooking condition for each menu;

menu group displaying means installed on the support plate for displaying the menu groups according to movement of the manipulation unit;

menu displaying means installed on the support plate for displaying the menus belonging to each menu group according to movement of the manipulation unit;

a selection unit for selecting a desired menu group and a desired menu from the menu groups and the menu displayed on the menu group displaying means and the menu displaying means, respectively; and a controller for controlling the heat source to perform the cooking condition of the selected menu according to selection of the selection unit;

wherein the manipulation unit comprises a rotary knob being rotatable, and wherein the menu group displaying means includes an annular display for displaying the menu groups in sequence around the rotary knob.

2. A cooker according to claim 1, wherein the selection unit comprises a selection switch operating by pushing of the rotary knob.

3. A cooker according to claim 1, wherein the annular display includes a plurality of icons for displaying the menu groups.

4. A cooker according to claim 3, further comprising a plurality of LCDs corresponding to the respective icons of the annular display.

5. A cooker according to claim 4, wherein the menu displaying means displays the menus on the annular display according to rotation of the rotary knob in sequence.

6. A cooker according to claim 4, wherein the menu displaying means comprises a second display for displaying the menus according to rotation of the rotary knob in sequence.

7. A cooker according to claim 6, wherein the second display displays the respective menus one by one and in sequence.

8. A cooker according to claim 6, wherein the second display highlights the menu corresponding to the rotation position of the rotary knob among the plurality of menus to be displayed on the second display.

9. A cooker according to claim 1 wherein the menu group displaying means includes a display for displaying the menu groups in sequence according to rotation of the rotary knob.

10. A cooker according to claim 9, wherein the menu displaying means displays the menus under the menu group selected through the selection unit on the display.

11. A cooker according to claim 10, wherein the display displays the respective menu groups one by one and in sequence.

12. A cooker according to claim 10, wherein the display highlights the menu group corresponding to the rotation position of the rotary knob among the plurality of menu groups to be displayed on the display.

13. A cooker according to claim 1, comprising an indicator for indicating rotation positions of the rotary knob. of the rotary knob.

14. A cooker according to claim 13, wherein the indicator is provided on the rotary knob.

15. A cooker according to claim 13, wherein the indicator comprises a plurality of LEDs provided around the rotary knob, corresponding to rotation positions of the rotary knob.

16. A cooker according to claim 15, wherein the plurality of LEDs are lighted sequentially during cooking.

* * * * *